US005222622A

United States Patent [19]

Laske, Jr.

[11] Patent Number: 5,222,622

[45] Date of Patent: Jun. 29, 1993

[54] DETACHABLE CONNECTION BETWEEN A CONTAINER AND A UTENSIL

[76] Inventor: Lawrence L. Laske, Jr., 1000 Springhaven Dr., Libertyville, Ill. 60048

[21] Appl. No.: 908,219

[22] Filed: Jul. 1, 1992

[51] Int. Cl.[5] ..... A47G 19/02; A45C 11/20

[52] U.S. Cl. ..... 220/574.1; 206/541; 206/553; D7/505

[58] Field of Search ..... 206/541, 553; 220/574, 220/574.1; D7/505, 645, 643, 642, 648

[56] References Cited

U.S. PATENT DOCUMENTS

| | | | |
|---|---|---|---|
| D. 217,632 | 5/1970 | Bouchet . | |
| 269,054 | 12/1882 | Hemsteger | 220/574 |
| 1,251,549 | 1/1918 | McDonald et al. | 220/574 |
| 2,584,379 | 2/1952 | Chmielewski | 206/541 X |
| 2,652,702 | 9/1953 | Hintze . | |
| 3,029,969 | 4/1962 | Buchel . | |
| 3,565,245 | 2/1971 | Asher . | |
| 3,704,779 | 12/1972 | Nigg . | |
| 3,939,976 | 2/1976 | VanIseghem, Jr. . | |
| 4,863,033 | 9/1989 | Buj . | |
| 4,930,637 | 6/1990 | De Roseau | 206/541 |

FOREIGN PATENT DOCUMENTS

| | | | |
|---|---|---|---|
| 32706 | of 1827 | United Kingdom | 220/574.1 |
| 8324 | of 1889 | United Kingdom | 220/574.1 |
| 2043 | of 1911 | United Kingdom | 220/574.1 |

*Primary Examiner*—William I. Price

*Attorney, Agent, or Firm*—Speckman, Pauley & Fejer

[57] ABSTRACT

A reusable apparatus for detachably connecting a utensil to a container. A rim protrudes from the container. An outer portion of the rim has either a male connector or a female connector. The utensil has a shaft which includes either a male or female connector, depending upon the type of connector of the rim of the container. The male connector has a cross-section with an inner thickness that is less than a maximum outer thickness. The female connector has two cantilever prongs which form a longitudinal opening that lockingly mates with the male connector. The utensil of this invention can be attached, detached and again attached to the container.

20 Claims, 13 Drawing Sheets 10
11
16
43
44
27
30
31
46

DETACHABLE CONNECTION BETWEEN A CONTAINER AND A UTENSIL

BACKGROUND OF THE INVENTION

1. Field of the Invention

This invention relates to an apparatus for detachably connecting or attaching a utensil to a rim of a container. With the detachable connection of this invention, a utensil can be attached, detached and used, and then re-attached to the rim of a container, all in an aesthetically pleasant manner.

2. Description of Prior Art

Conventional apparatuses exist for attaching eating utensils to plates, panels and the like. For example, U.S. Pat. No. 3,565,245 teaches a combination food container and utensil in which the utensil is outlined by slits in the utensil material. The eating utensil is integrally constructed with sheet material of a panel by a pair of opposed, relatively short, frangible tabs. The tabs provide a bridge which interconnects the utensil with the panel. The utensil is accessed by applying pressure to the projecting ends of the utensil to cause the tabs to break. It is apparent that once the utensil is detached with respect to the panel and the tabs are broken, the utensil cannot be re-attached to the panel.

U.S. Pat. No. 4,863,033 teaches a set of eating utensils for children. The eating utensils are attached to a plate. A toy figure is attached to the plate. The plate has pegs for mounting a spoon, fork or knife, each of which has an identical or complementary toy figure removably attached to the handle of the spoon, fork or knife. The handle of the utensil has a hole into which the peg fits so that the utensil can be attached to the plate.

U.S. Pat. No. 3,704,779 and U.S. Pat. No. 217,632 disclose utensils having breakable bridges or necks for attaching an eating utensil to a main tray part. The utensils are supported by projections which have narrow plastic bridges that can be easily broken by a user. The plastic bridges are relatively small in cross section so as to permit easy fracturing by the user. The utensils taught by such patents cannot be re-attached to the plate.

U.S. Pat. No. 3,029,969 discloses a table setting device wherein utensils are positioned within compartments separated by dividing walls. U.S. Pat. No. 3,939,976 also teaches a table setting device in which multiple table place settings are attached or mounted to a roll of flexible material. Each section is separated from each other by perforations, for removal of one or more place settings.

U.S. Pat. No. 2,652,702 discloses a combination picnic tray and platter wherein the tray is divided into various compartments. Each corresponding compartment accepts a drinking container, a knife, a fork, a spoon or a napkin.

It is apparent from such prior patents that there exists a need for an apparatus in which a utensil, such as an eating utensil, can be detachably connected or attached to a container in a re-usable fashion.

SUMMARY OF THE INVENTION

It is one object of this invention to provide an apparatus having an eating utensil which is detachably connected or attached to a container, such as a dinner plate.

It is another object of this invention to provide a detachable connection between an eating utensil and a plate or other container wherein the mating pieces for the connection are integrally formed with the eating utensil and with a rim of the container.

It is still another object of this invention to provide an attachable connection between an eating utensil and a container wherein the connecting pieces are aesthetically integrated with the eating utensil and the container.

The above and other objects of this invention are accomplished with a re-usable apparatus for detachably connecting a utensil to a container wherein the container has a rim protruding from at least a portion of the container. An outer portion of the rim has a male connector with a cross section having an inner thickness that is less than a maximum outer thickness of the cross section. Such cross-sectional arrangement of the male connector accommodates two cantilever prongs in a clamping fashion, which is described below in further detail.

The utensil has a shaft and the two cantilever prongs extend from the shaft to form a longitudinal opening. The longitudinal opening has a cross section which is lockingly mateable with the external cross section of the male connector.

Throughout the preferred embodiments in reference to this invention, the detachable attachment between the eating utensil and the container is accomplished with the male connector and the cantilever prongs, which are generally described as a female connector. The connection between the male connector and the female connector includes a structural element or structural design for locking the male connector with respect to the female connector, and thus for locking the eating utensil with respect to the rim of a plate or other container. It is apparent that such connection must be rigid enough for the eating utensil to remain in a fixed position with respect to the container yet resilient enough for the force maintaining the locked connection to be easily overcome by a casual hand force exerted by a user of the utensil.

Many preferred embodiments of such connection are discussed below in further detail. Various possibilities for the detachable and lockable connection or attachment between the eating utensil and the container will become more apparent when this specification is read in view of the drawings.

BRIEF DESCRIPTION OF THE DRAWINGS

Many advantages of this invention will become apparent when the invention is considered with the drawings, wherein.

DESCRIPTION OF PREFERRED EMBODIMENTS

Figure 1:
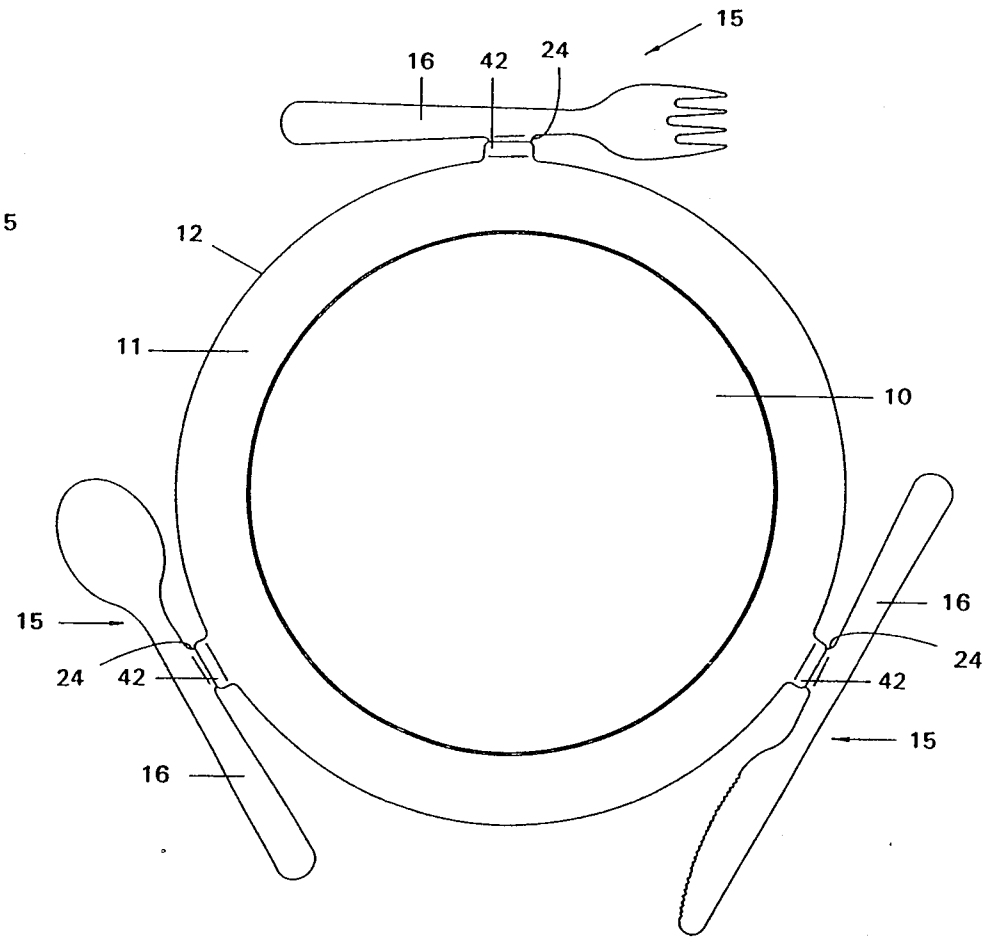
FIGS. 1, 2, 3, 4 and 5 each show a plan view of eating utensils detachably connected to a rim of a plate, each according to one preferred embodiment of this invention.
Figure 1A:
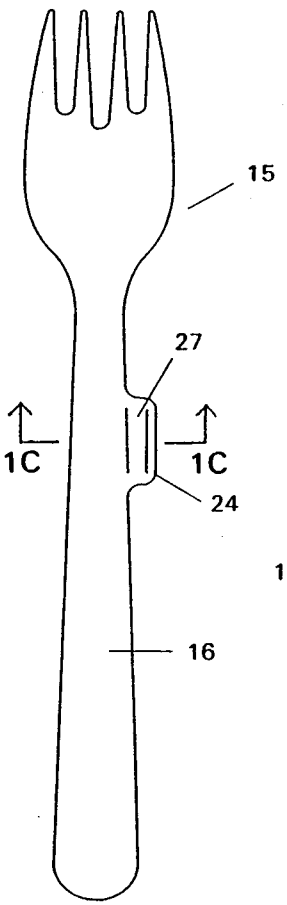
FIGS. 1A, 2A, 3A, 4A and 5A each show a plan view of an eating utensil, according to the corresponding preferred embodiments of this invention.

This invention is directed to a detachable connection between a utensil, preferably an eating utensil, and a container, preferably a dinnerware container such as a plate, a bowl, a saucer or the like. This specification describes various male and female connectors each of which are either secured to or preferably integral with a peripheral rim of the container. As the various embodiments are discussed in detail below, it is intended throughout the discussion that the male and female roles can be interchanged without departing from objective of this invention.

Referring first to FIGS. 1A–1G, container 10 is shown as a dinner plate or other suitable plate for holding foodstuffs. It is apparent that container 10 can be any other suitable piece of dinnerware or other container. Utensil 15 is shown in the drawings as either a fork, a spoon or a knife. However, it is apparent that utensil 15 can be any other suitably shaped utensil or tool for connecting to container 10.

Figure 2:
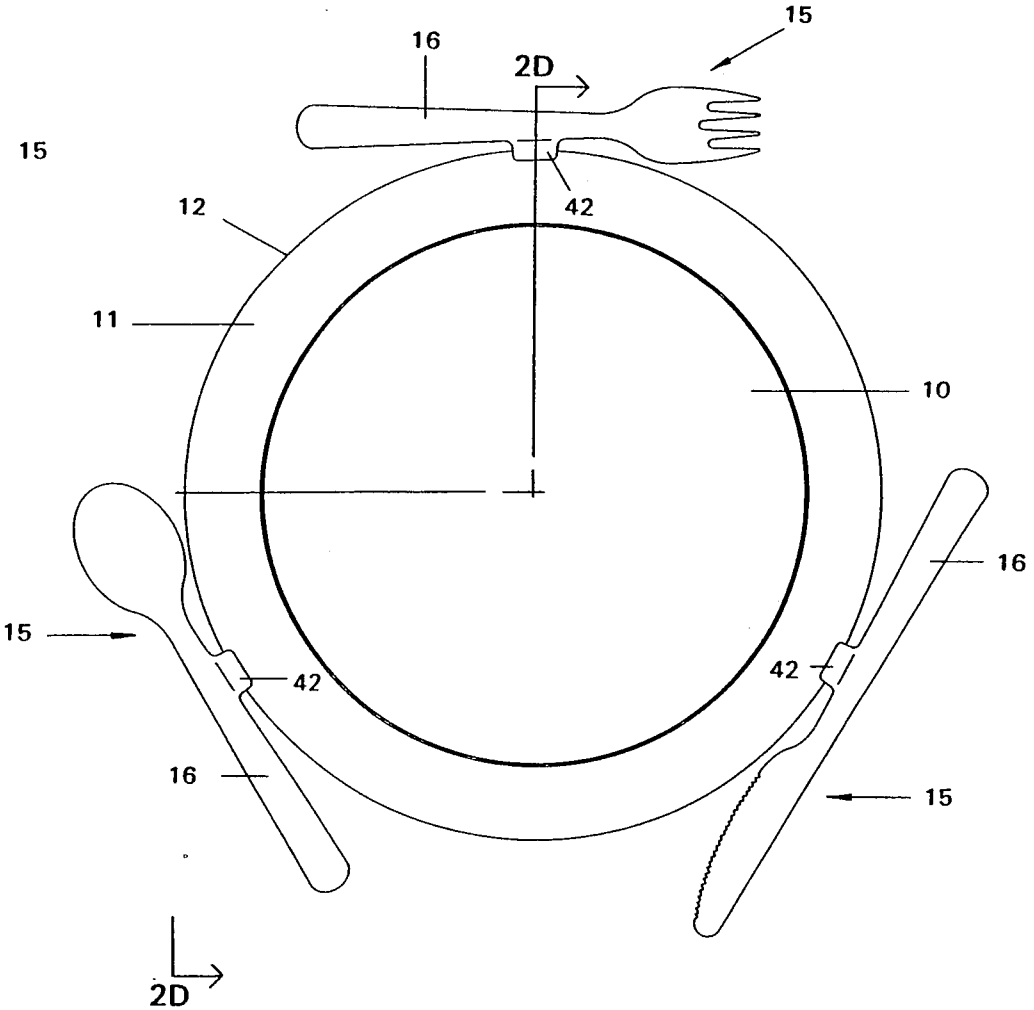
Figure 2A:
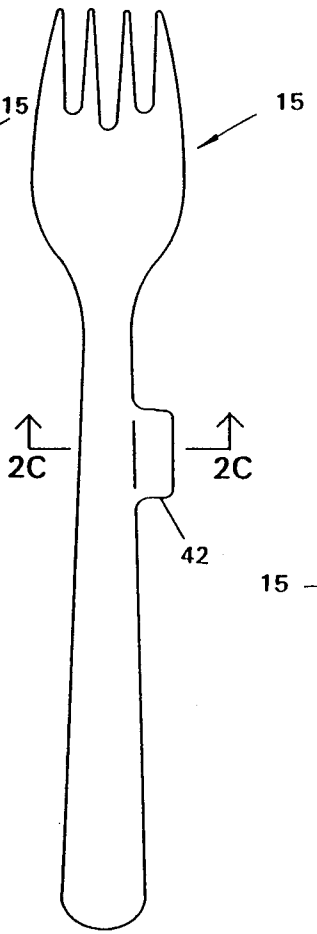
Figure 2B:
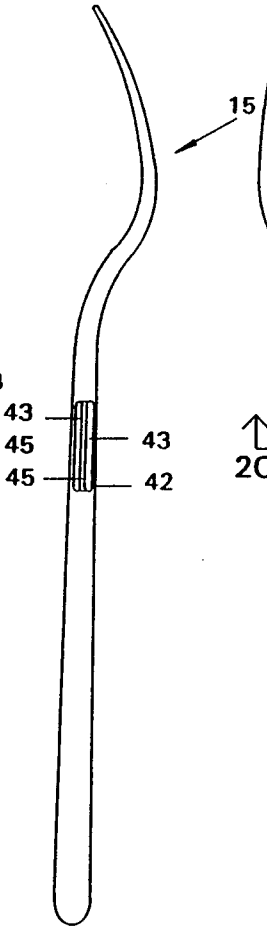

Rim 11 protrudes from at least a portion of container 10. As shown in FIG. 1, rim 11 is arranged about the entire periphery of container 10. According to the preferred embodiment shown in FIGS. 1, 3 and 4, two cantilever prongs 43 extend outward from rim 11 and form longitudinal opening 45 of female connector 42. FIGS. 2 and 5 show the reverse roles between male connector 24 and female connector 42, wherein outer portion 13 of rim 11 has male connector 24 either attached to rim 11 or integrally formed with rim 11.

Figure 1B:
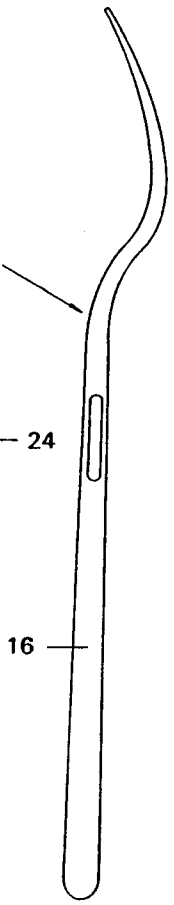
FIGS. 1B, 2B and 5B each show a side view of the corresponding eating utensil as shown in FIGS. 1A, 2A and 5A, respectively.
Figure 1C:
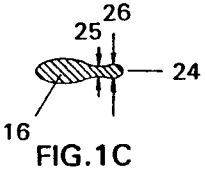
FIGS. 1C, 2C, 3C, 4C and 5C each show a cross-section taken along lines 1C—1C, 2C—2C, 3C—3C, 4C—4C and 5C—5C, respectively, as shown in FIGS. 1A, 2A, 3A, 4A and 5A, respectively.
Figure 1D:
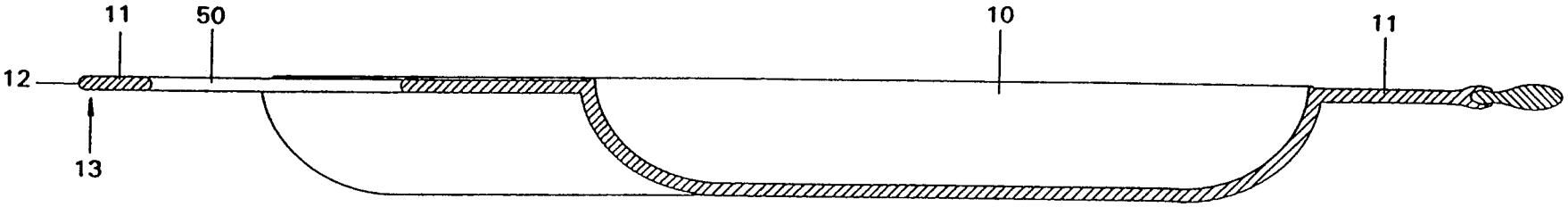
FIG. 1D shows a sectional view taken along line 1D—1D, as shown in FIG. 1H.
Figure 1E:
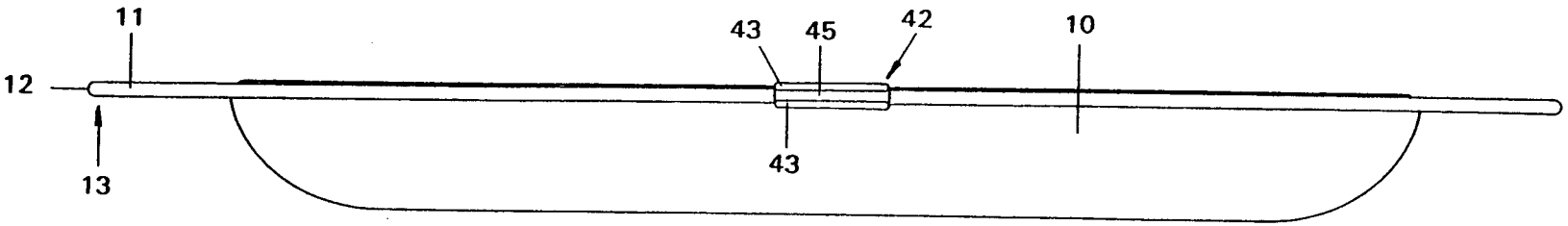
FIGS. 1E, 2E, 3E, 4E and 5E each show a side view of the container without the eating utensil attached, according to the corresponding preferred embodiments of this invention.
Figure 1F:
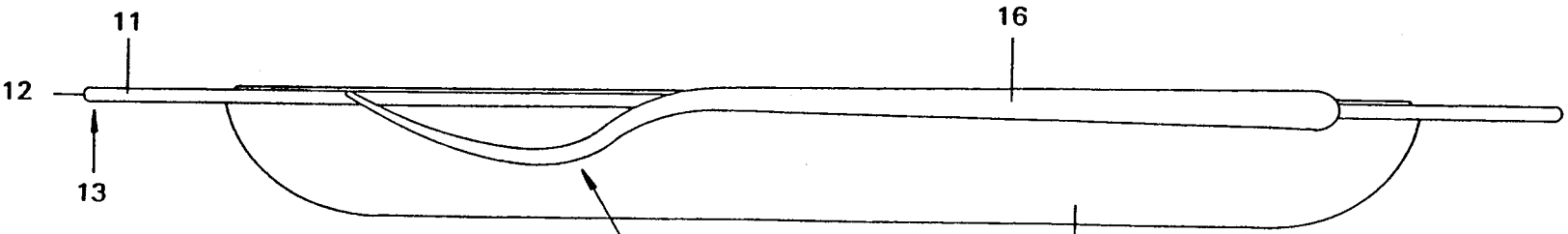
FIGS. 1F, 2F, 3F, 4F and 5F each show a side view of the container with the eating utensil attached, according to the corresponding preferred embodiments of this invention.
Figure 3:
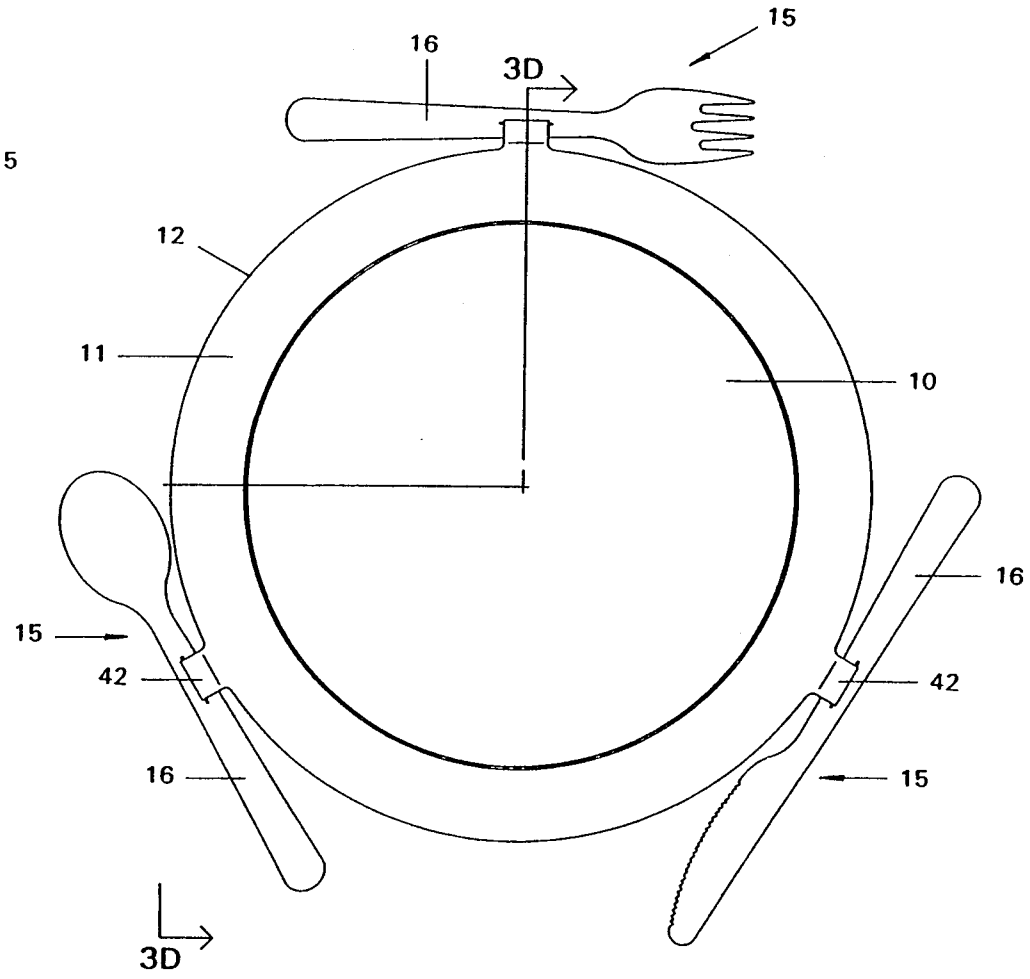
Figure 4:
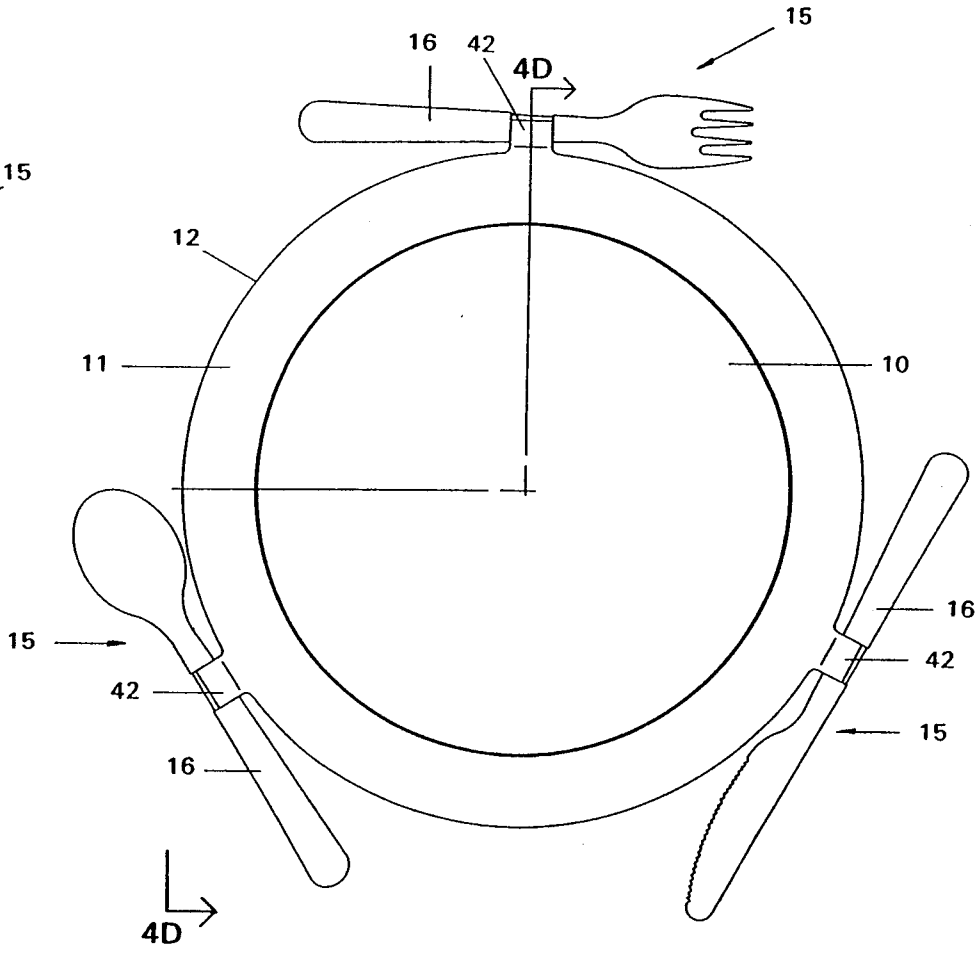
Figure 5:
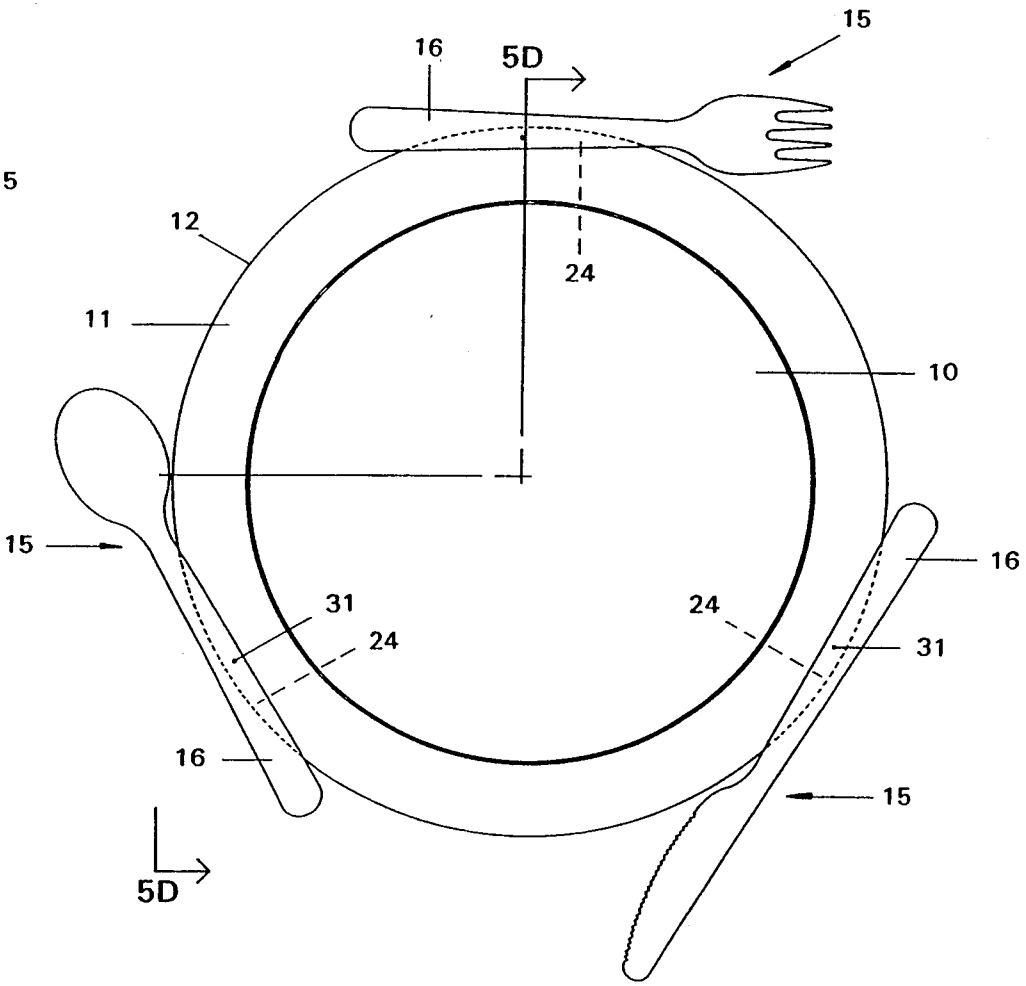

As shown in FIGS. 1, 3 and 4, utensil 15 comprises male connector 24. As shown in the preferred embodiments of FIGS. 2 and 5, outer portion 13 of rim 11 comprises male connector 24. Regardless of whether male connector 24 is a part of container 10 or utensil 15, male connector 24 preferably has a connector cross-section with inner thickness 25 being less than a maximum outer thickness 26, as best shown in FIG. 1B.

As used throughout this specification and in the claims, describing male connector 24 as having inner thickness 25 less than a maximum outer thickness 26 relates to the technical aspect that enables a locking connection to be formed between male connector 24 and female connector 42. Cantilever prongs 43 of female connector 42 are preferably constructed of a material that is strong enough to resist fracture or failure when deflected to be positioned over male connector 24 at outer thickness 26, but yet is resilient enough to return to its original position where tip portion 44 of cantilever prong 43 lockingly mates within longitudinal channel 27, as best shown in FIG. 1G. In such locked position, utensil 15 is secured with respect to container 10. However, the materials are preferably selected and male connector 24 and female connector 42 are preferable designed to be relatively easily detached from their connected position by the casual hand force of a user.

Figure 1H:
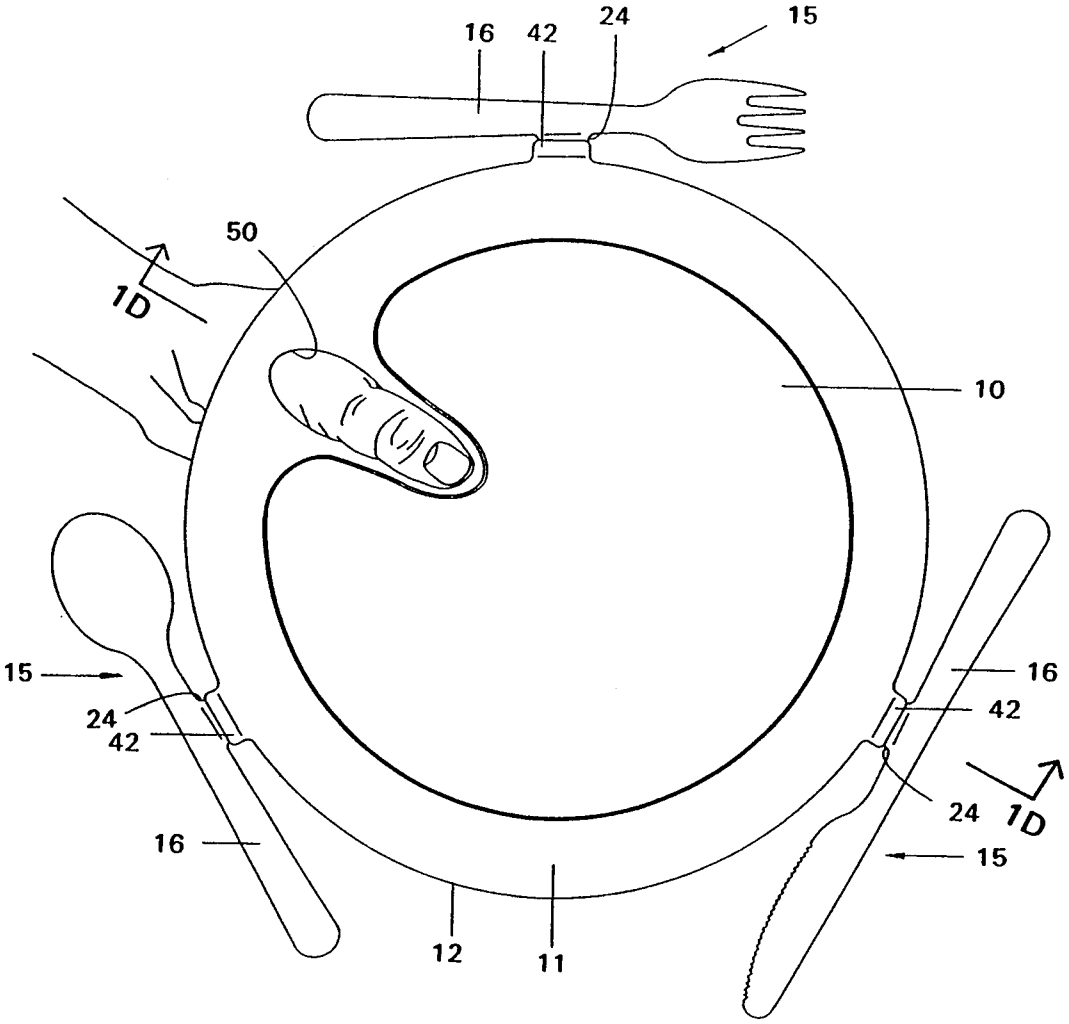
FIG. 1H shows a plan view of the eating utensils detachably connected to a container, according to yet another preferred embodiment of this invention.
Figure 2C:
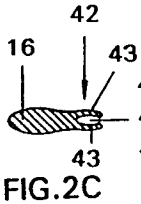
Figure 2D:
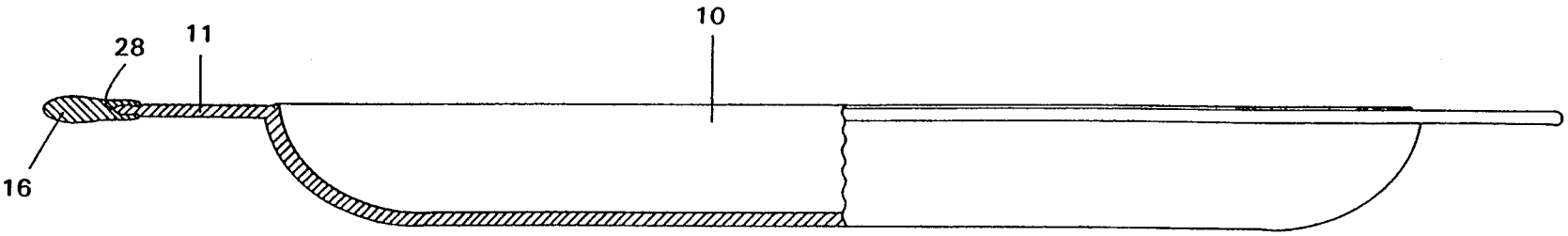
FIGS. 2D, 3D, 4D and 5D each show a sectional view taken along the lines 2D—2D, 3D—3D, 4D—4D and 5D—5D, respectively, as shown in FIGS. 2, 3, 4 and 5, respectively.
Figure 2E:
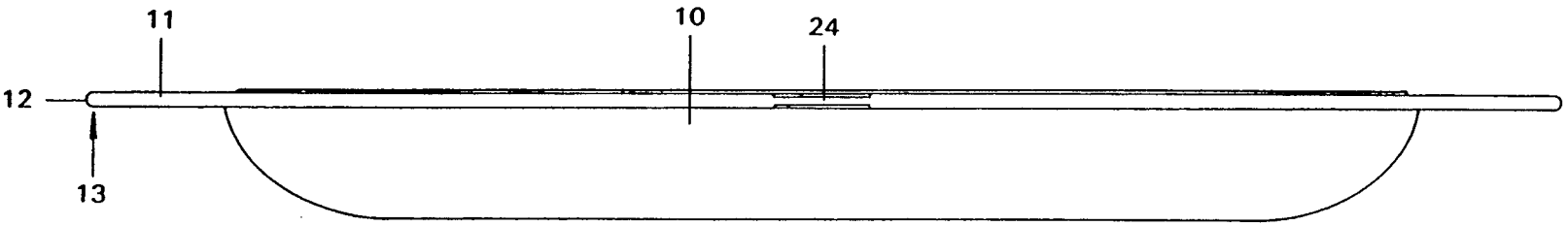
Figure 2F:
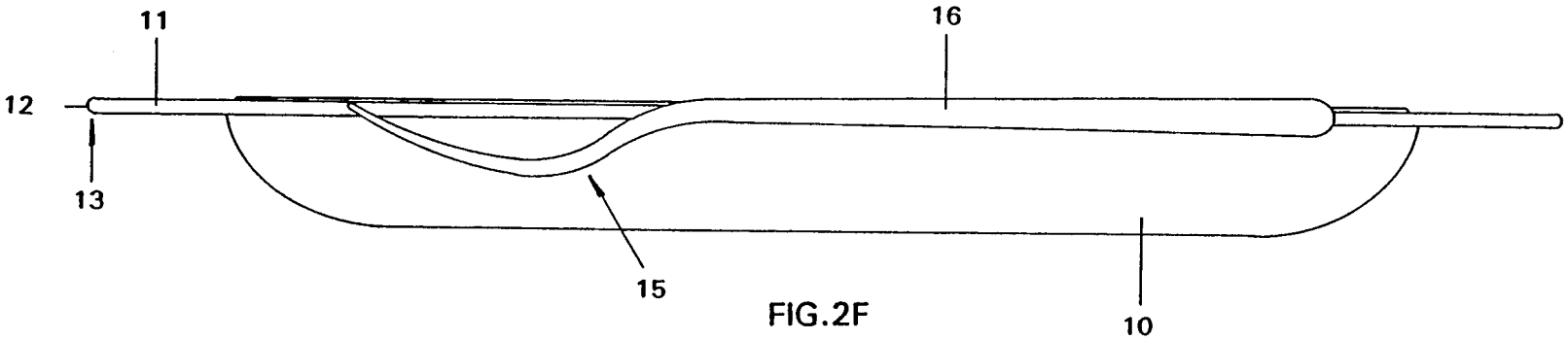
Figures 1G, 3G, 4G, 5G:
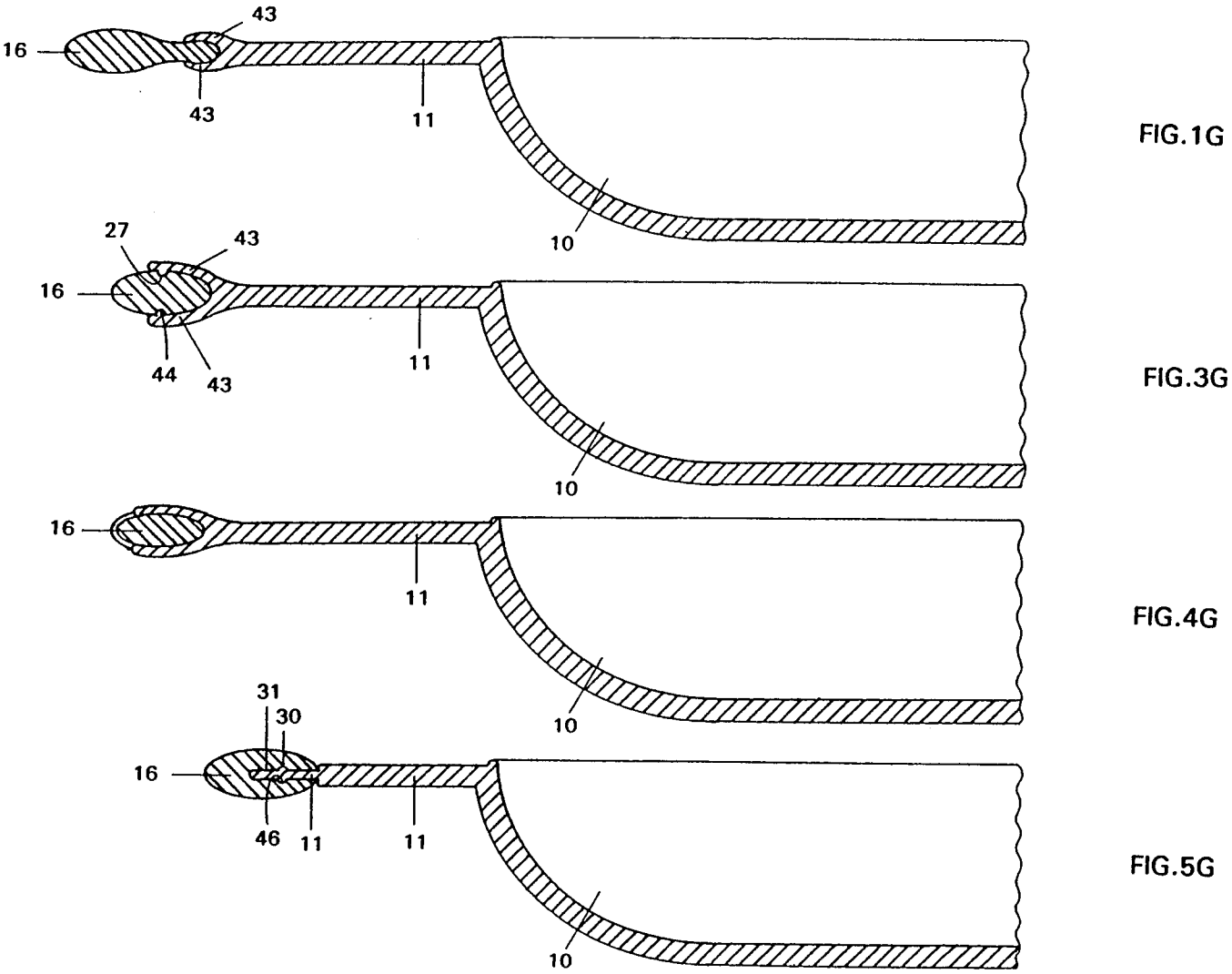
FIGS. 1G, 2G, 3G, 4G and 5G each show an enlarged, partial cross-sectional view of the container with the utensil attached, taken through a male connector and a female connector, with the eating utensil attached to the container, according to the corresponding preferred embodiments of this invention.
Figure 4D:
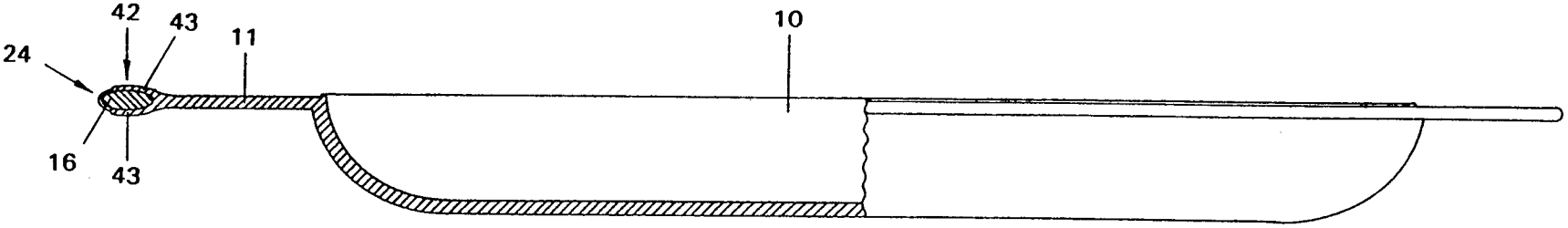
Figure 4E:
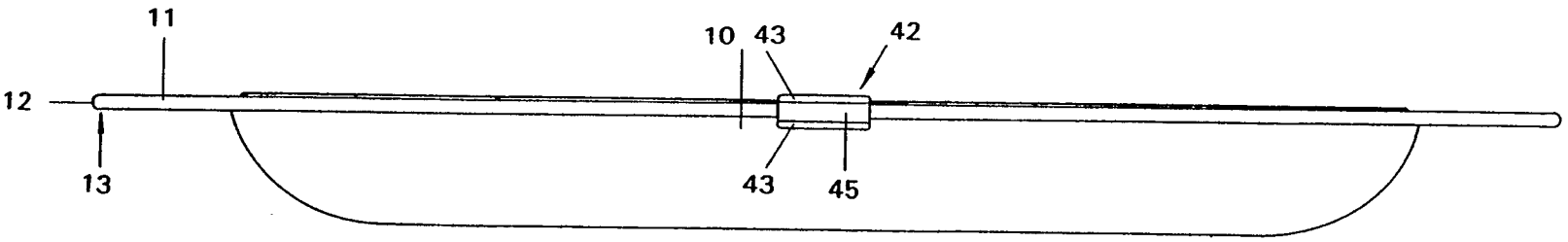
Figure 4F:
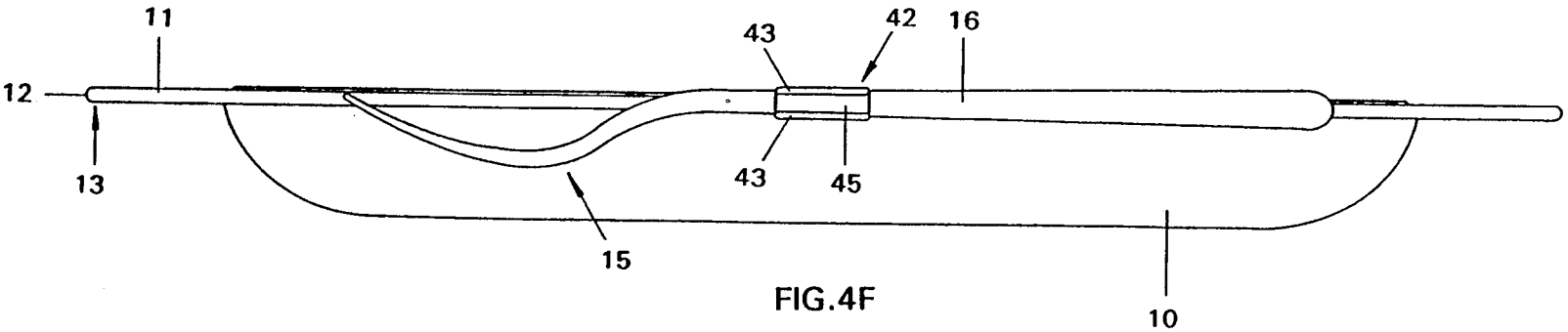
Figure 2G:
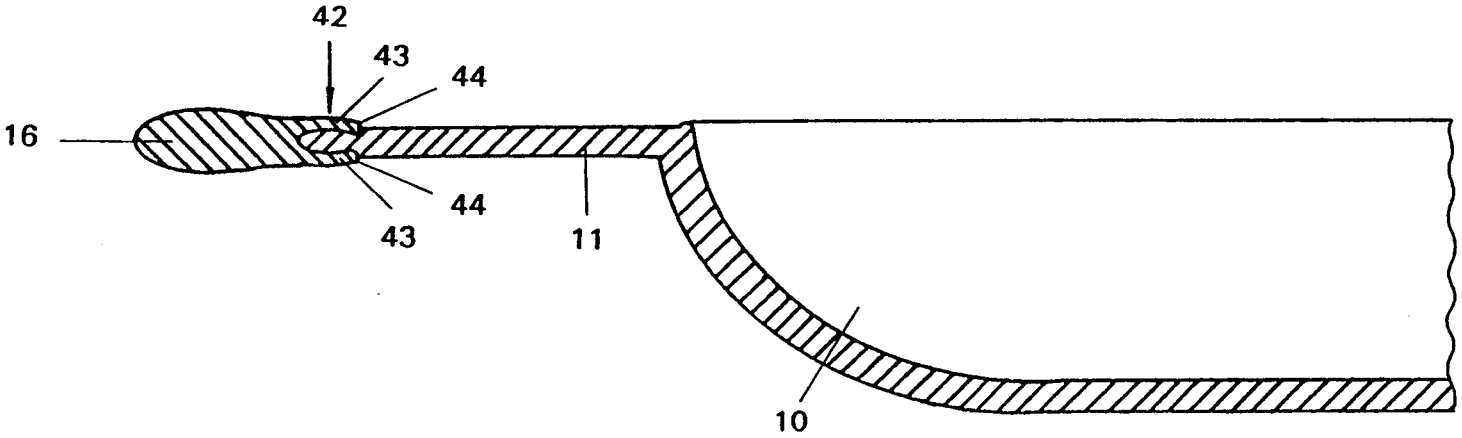

As clearly shown in FIGS. 2C, 2G and 3G, for example, cantilever prongs 43 have a tip portions 44 which converge toward each other in an outwardly direction, with respect to cantilever prong 43. Tip portion 44 can be enlarged, to mate with the corresponding longitudinal channel 27. It is apparent that other suitable arrangements can be used to form a locking connection between male connector 24 and female connector 42. For example, as shown in FIG. 3G, tip portion 44 has an extending rib which mates with a correspondingly cut groove or longitudinal channel 27 within shaft 16. It is also apparent that other suitable locking arrangements can be achieved by reversing the roles of many of the described elements.

As shown in FIGS. 2, 2D, and 2E, connector outer edge 28 is flush with rim outer edge 12. Such preferred embodiment provides an aesthetically pleasant and practical physical arrangement.

As shown in FIG. 5G, male connector 24 has raised surface 30 projecting outward from face surface 31 and shaft 16 has indentation 46 which mateingly engages with raised surface 30 to lockingly connect shaft 16 with respect to rim 11. Again, it is apparent that reversal of the roles between indentation 46 and raised surface 30, with respect to container 10 and utensil 15, will result in the same result of a detachable and lockable connection between container 10 and utensil 15.

Figure 5A:
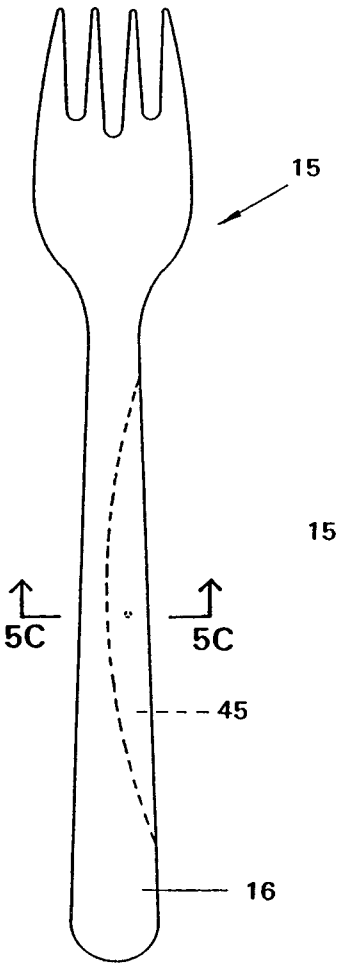
Figure 5B:
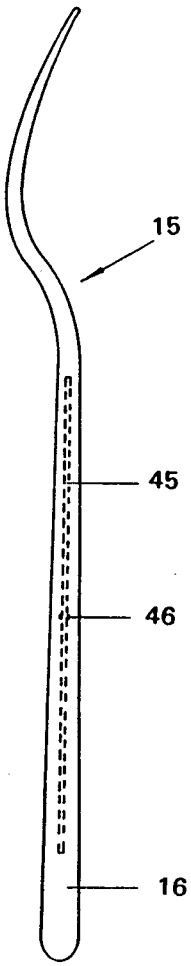
Figure 5C:
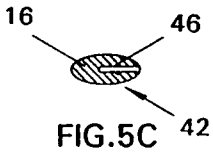
Figure 5D:
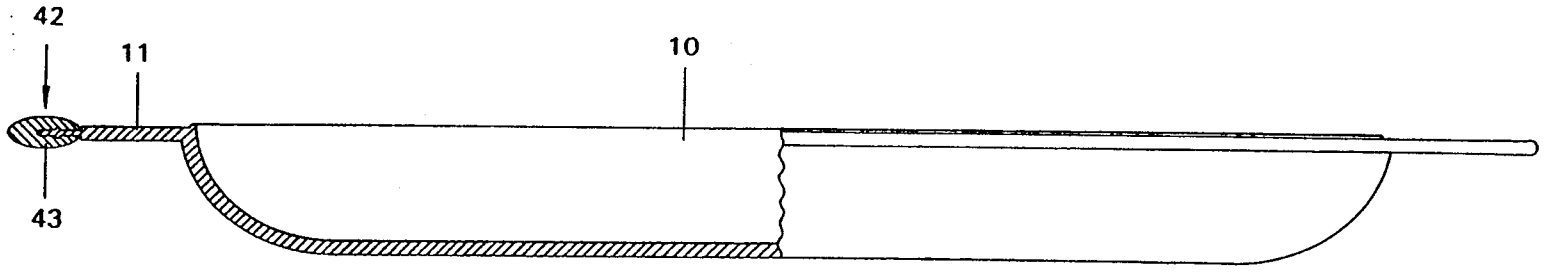
Figure 5E:
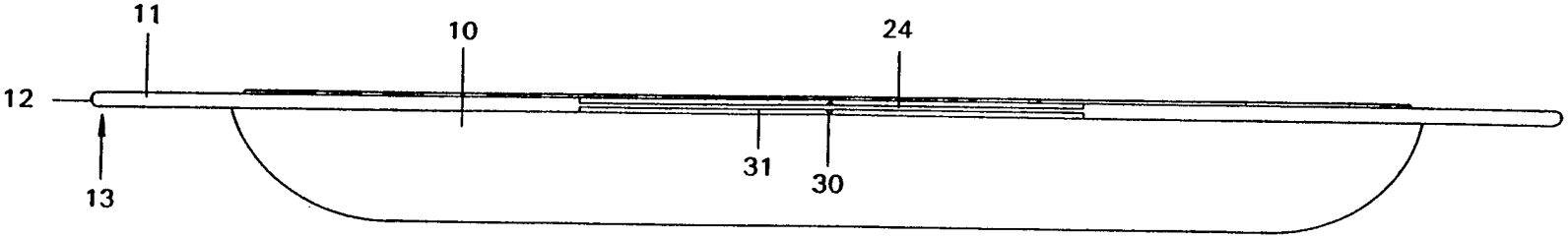
Figure 5F:
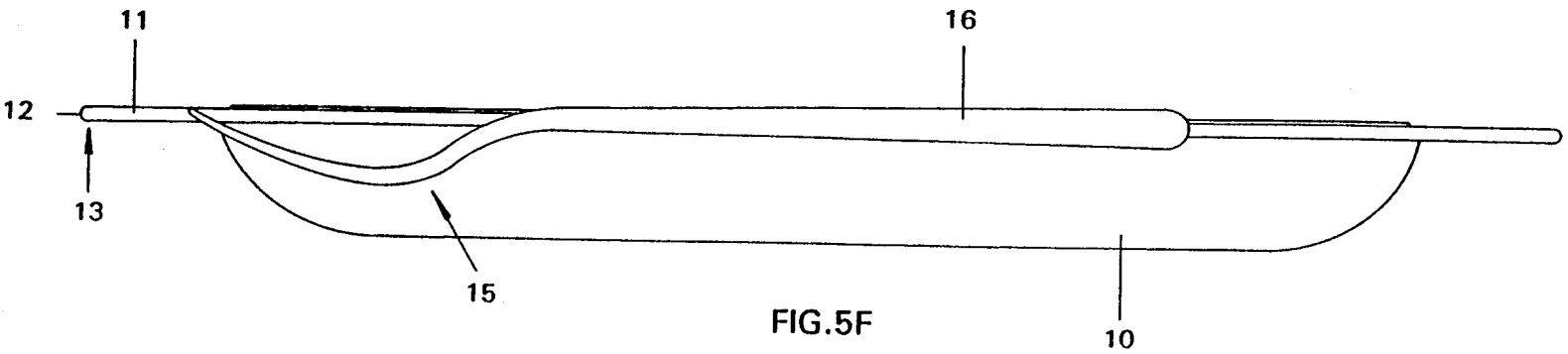

As shown in FIG. 5, rim 11 comprises male connector 24. In such preferred embodiment of this invention, male connector 24 is a relatively flat section, as best shown in FIG. 5C, of an arcuate portion of rim 11, as best shown in FIG. 5. As shown in FIG. 5A, utensil 15 comprises a channel or longitudinal opening 45 which mates with the relatively flat section of rim 11. As shown in FIGS. 5A, 5C and 5G, indentation 46 and raised surface 30 mate to lockingly and detachably connect utensil 15 with respect to container 10.

Figure 3A:
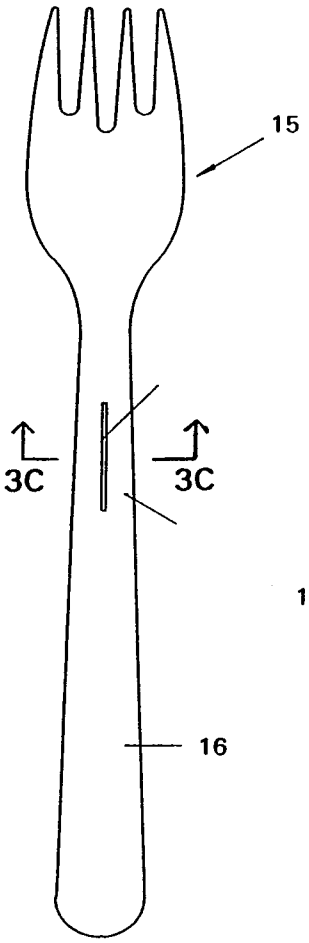
Figure 3B:
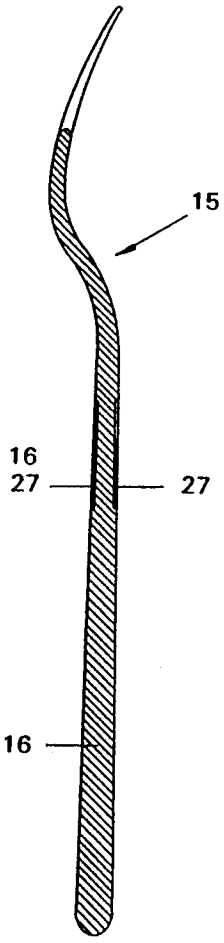
FIGS. 3B and 4B each show a cross-sectional side view taken along the center axis of the corresponding eating utensil as shown in FIGS. 3A and 4A, respectively.
Figure 3C:
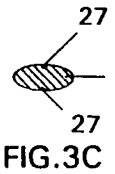
Figure 3D:
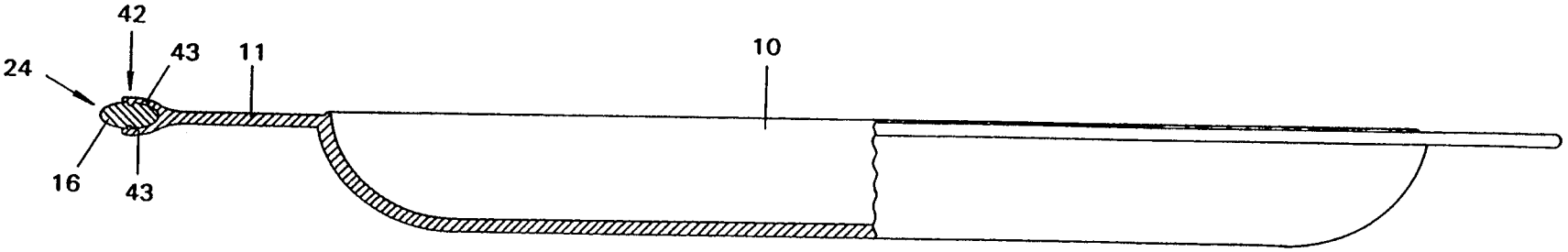
Figure 3E:
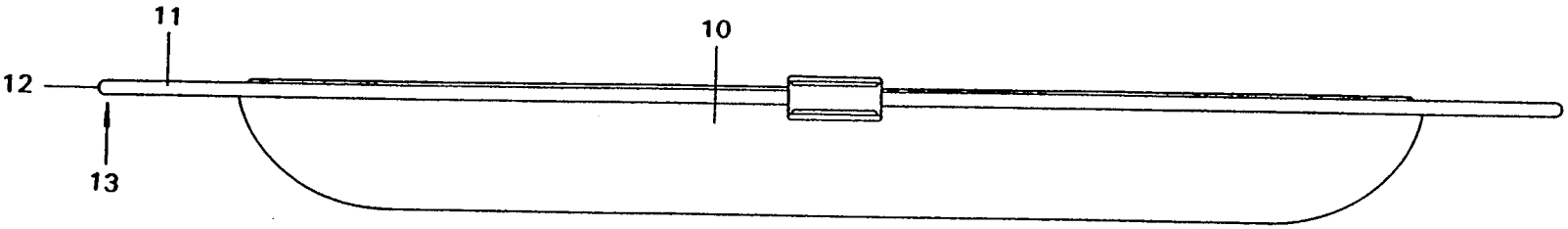
Figure 3F:
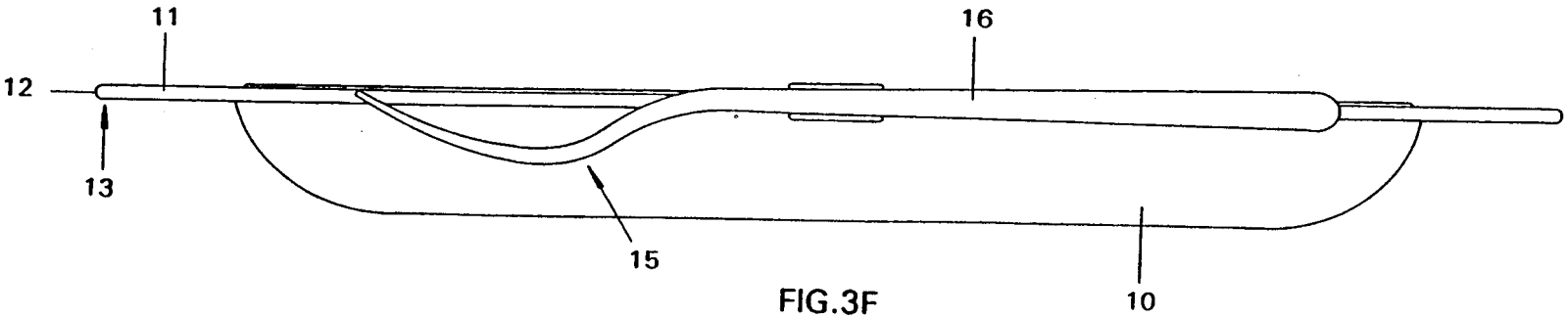

As shown in FIGS. 3A and 3C, shaft 16 has longitudinal channel 27 which mates with tip portion 44 of cantilever prong 43, as clearly shown in FIG. 3G.

Figure 4A:
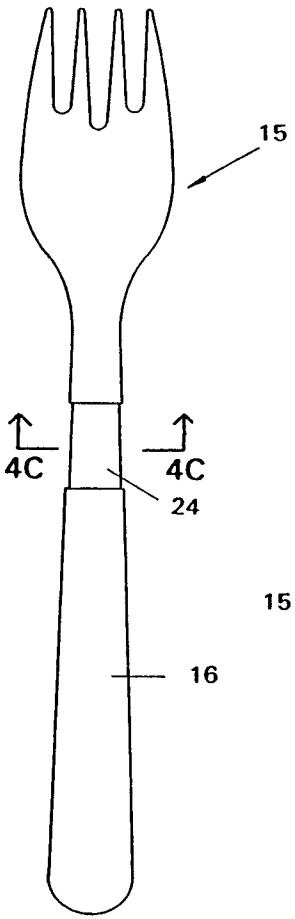
Figure 4B:
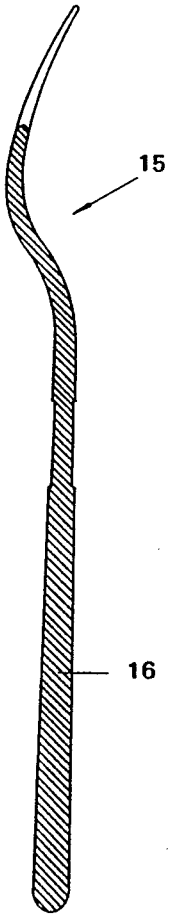
Figure 4C:
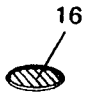

As shown in FIGS. 4A–4C, shaft 16 of utensil 15 forms male connector 24 by having a reduced cross-sectional area of shaft 16. It is apparent that such reduced cross-sectional area can extend around only a portion of shaft 16 or around the complete periphery of shaft 16, as shown in FIG. 4C.

FIG. 1H shows one preferred embodiment of container 10, according to this invention. Thumb opening 50 is conveniently positioned for accommodating a user's thumb for handling o carrying container 10.

While in the foregoing specification this invention has been described in relation to certain preferred embodiments thereof, and many details have been set forth for purpose of illustration it will be apparent to those skilled in the art that the invention is susceptible to additional embodiments and that certain of the details described herein can be varied considerably without departing from the basic principles of the invention.

I claim:

1. A reusable apparatus for detachably connecting a utensil to a container, the apparatus comprising:

a rim protruding from at least a portion of the container, an outer portion of said rim having a male connector, said male connector having a connector cross section with an inner thickness less than a maximum outer thickness; and the utensil having a shaft, two cantilever prongs extending from said shaft and forming a longitudinal opening, said longitudinal opening having an opening cross section lockingly mateable with connector cross section.

2. A reusable apparatus according to claim 1 wherein said male connector has a longitudinal channel and said male connector has said inner thickness at said longitudinal channel.

3. A reusable apparatus according to claim 2 wherein said cantilever prongs each have a tip portion and said tip portions converge toward each other in an outwardly direction.

4. A reusable apparatus according to claim 3 wherein each said tip portion is enlarged and said enlarged tip portion is mateable within said longitudinal channel.

5. A reusable apparatus according to claim 3 wherein said cantilever prongs are deflectable in a direction away from each other.

6. A reusable apparatus according to claim 1 wherein a connector outer edge of said male connector is flush with a rim outer edge of said rim.

7. A reusable apparatus according to claim 1 wherein said male connector has a raised surface projecting outward from a face surface of said male connector.

8. A reusable apparatus according to claim 7 wherein an inner surface of one said cantilever prong has an indentation and said indentation is mateable with said raised surface.

9. A reusable apparatus according to claim 1 wherein an inner surface of one said cantilever prong has an indentation.

10. A reusable apparatus for detachably connecting a utensil to a container, the apparatus comprising:

a rim protruding from at least a portion of the container, two cantilever prongs extending outward from said rim and forming a longitudinal opening, said longitudinal opening having an opening cross section; and the utensil having a shaft forming a male connector, said male connector having a connector cross section with an inner thickness less than a maximum outer thickness, said male connector having a connector cross section lockingly mateable with said opening cross section.

11. A reusable apparatus according to claim 10 wherein said male connector has a longitudinal channel and said male connector has said inner thickness at said longitudinal channel.

12. A reusable apparatus according to claim 11 wherein said cantilever prongs each have a tip portion and said tip portions converge toward each other in an outwardly direction.

13. A reusable apparatus according to claim 12 wherein each said tip portion is enlarged and said enlarged tip portion is mateable within said longitudinal channel.

14. A reusable apparatus according to claim 12 wherein said cantilever prongs are deflectable in a direction away from each other.

15. A reusable apparatus according to claim 10 wherein a prong outer edge of each said cantilever prong is flush with a rim outer edge of said rim.

16. A reusable apparatus according to claim 10 wherein said male connector has a raised surface projecting outward from a face surface of said male connector.

17. A reusable apparatus according to claim 16 wherein an inner surface of one said cantilever prong has an indentation and said indentation is mateable with said raised surface.

18. A reusable apparatus according to claim 10 wherein said male connector further comprises said shaft having a channel around at least a portion of a periphery of said shaft.

19. A reusable apparatus according to claim 18 wherein said channel extends along a length of said shaft for a distance approximately equal to a width of a widest said cantilever prong.

20. A reusable apparatus according to claim 10 wherein said male connector extends outward from said shaft.

* * * * *